US011261572B1

(12) United States Patent
Knight

(10) Patent No.: US 11,261,572 B1
(45) Date of Patent: Mar. 1, 2022

(54) SCOOPER APPARATUS

(71) Applicant: Amy Knight, Sugar Hill, GA (US)

(72) Inventor: Amy Knight, Sugar Hill, GA (US)

( * ) Notice: Subject to any disclaimer, the term of this patent is extended or adjusted under 35 U.S.C. 154(b) by 0 days.

(21) Appl. No.: 17/404,360

(22) Filed: Aug. 17, 2021

Related U.S. Application Data

(60) Provisional application No. 62/706,665, filed on Sep. 2, 2020.

(51) Int. Cl.
*E01H 1/12* (2006.01)

(52) U.S. Cl.
CPC ..... *E01H 1/1206* (2013.01); *E01H 2001/122* (2013.01)

(58) Field of Classification Search
CPC ..... E01H 1/1206; E01H 2001/122
See application file for complete search history.

(56) References Cited

U.S. PATENT DOCUMENTS

| | | | | |
|---|---|---|---|---|
| 8,714,604 | B1 * | 5/2014 | Mihalic | E01H 1/1206 294/1.4 |
| 9,469,951 | B1 * | 10/2016 | Qi | E01H 1/1206 |
| 10,801,171 | B1 * | 10/2020 | McCormick | E01H 1/12 |
| 2014/0327256 | A1 * | 11/2014 | Zurn | E01H 1/1206 294/1.4 |
| 2018/0305877 | A1 * | 10/2018 | Weber | B65F 1/1468 |
| 2019/0320617 | A1 * | 10/2019 | Weatherly | A01K 27/007 |

* cited by examiner

*Primary Examiner* — Stephen A Vu
(74) *Attorney, Agent, or Firm* — My Patent Guys; Christopher Pilling

(57) ABSTRACT

An improved scooper apparatus is provided. The scooper having an article-engaging assembly including a pair of article-engaging implements configured to open and close via a handle member. The article-engaging implement has a generally concave interior surface creating a bucket-like configuration. An integral tubular member extends laterally from the article-engaging implement and terminates in and forms a raised lip at a perimeter edge of the tubular member. A bag-retaining member is disposed near the tubular member and is adapted for selectively engaging the perimeter of the open end of a flexible bag for collecting.

12 Claims, 13 Drawing Sheets

SCOOPER APPARATUS

CROSS-REFERENCE TO RELATED APPLICATIONS

Field of the Invention

The present invention claims priority to U.S. Provisional Application Ser. No. 62/706,665 filed Sep. 2, 2020, the disclosure of which is hereby incorporated in its entirety at least by reference.

BACKGROUND

Field of the Invention

This present invention generally relates to scoopers, and more particularly, the present invention relates to a scooper apparatus that includes a bag retaining feature.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In one aspect of the invention, a scooper apparatus is provided, comprising a handle; an article-engaging assembly having a pair of article-engaging implements depending from the handle defining an interior and an exterior adapted for engaging a waste article from a surface and retaining the waste article within the interior; a chute extending laterally from a first article-engaging implement of the pair of article-engaging implements, wherein the chute has a first end terminating at an interior of the article-engaging assembly and an opposing second end distal of the first end, wherein the second end is adapted for receiving an open end of a bag; a raised lip positioned on an entire perimeter edge of the second end of the chute; and, a bag-retaining member configured to engage a perimeter of the open end of the bag, wherein the bag-retaining member is spring loaded via a tension spring.

In one embodiment, the bag-retaining member is configured to move from a retracted position to an extended position via the tension spring, wherein the retracted position is distal of the chute and the extended position is proximate of the chute. In one embodiment, the bag-retaining member comprises a hook. In another embodiment, the chute, the raised lip, and the first article-engaging implement is constructed as a single member.

In another aspect of the invention, a scooper is apparatus is provided comprising a handle; at least one article-engaging implement depending from the handle defining an interior and an exterior adapted for engaging an article from a surface and retaining within the interior; a tubular member extending laterally from the at least one article-engaging implement having a first end terminating at an interior of the article-engaging implement and an opposing second end distal the first end adapted for receiving an open end of a bag; and a bag-retaining member disposed proximate the second end of the tubular member adapted for engaging a perimeter of the open end of the bag.

In one embodiment, the article-engaging implement defines a concave interior surface. In one embodiment, the second end of the tubular member has a raised-lip perimeter. In one embodiment, the bag-retaining member is spring-loaded. In another embodiment, the bag-retaining member is spring-loaded between a retracted position distal the tubular member and an extended position proximate the tubular member. In one embodiment, the bag-retaining member is a hook. In one embodiment, an elongated connecting member is further provided, the elongated connecting member having the at least one article-engaging implement disposed at one end and the handle disposed at an opposing end. In one embodiment, the at least one article-engaging implement comprising a pair of opposing article-engaging implements adapted for engaging an article therebetween. In yet another embodiment, the article is animal waste. In one embodiment, a mechanism for selectively moving the pair of opposing article-engaging implements between a closed condition and an open condition is provided.

In yet another aspect of the invention, a method of retaining a flexible bag on a scooper apparatus, the method comprising steps (a) providing the scooper apparatus having a handle; an article-engaging assembly having a pair of article-engaging implements depending from the handle defining an interior and an exterior adapted for engaging a waste article from a surface and retaining within the interior; a chute extending laterally from a first article-engaging implement of the pair of article-engaging implements, wherein the chute has a first end terminating at an interior of the article-engaging assembly and an opposing second end distal of the first end; a raised lip positioned on an entire perimeter edge of the second end of the chute; and, a bag-retaining member configured to engage a perimeter of an open end of the bag, wherein the bag-retaining member is spring loaded via a tension spring; (b) placing an open end of the flexible bag over the second end of the chute and the raised lip; (c) positioning the bag-retaining member in an extended position by applying a force on the bag-retaining member and extending the tension spring; (d) engaging a portion of the flexible bag on the bag-retaining member; and, (e) positioning the bag-retaining member in a retracted positioned, by releasing the force, such that the portion of the flexible bag is secured on the bag-retaining member.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE FIGURES

The detailed description of some embodiments of the invention is made below with reference to the accompanying figures, wherein like numerals represent corresponding parts of the figures.

The novel features of the disclosure are set forth with particularity in the appended claims. A better understanding of the features and advantages of the present disclosure will be obtained by reference to the following detailed description that sets forth illustrative embodiments, in which the principles of the disclosure are utilized, and the accompanying drawings of which:

DETAILED DESCRIPTION

While preferred embodiments of the present disclosure have been shown and described herein, it will be obvious to those skilled in the art that such embodiments are provided by way of example only. Numerous variations, changes, and substitutions will now occur to those skilled in the art without departing from the disclosure. It should be understood that various alternatives to the embodiments of the disclosure described herein may be employed in practicing the disclosure.

Figure 1:
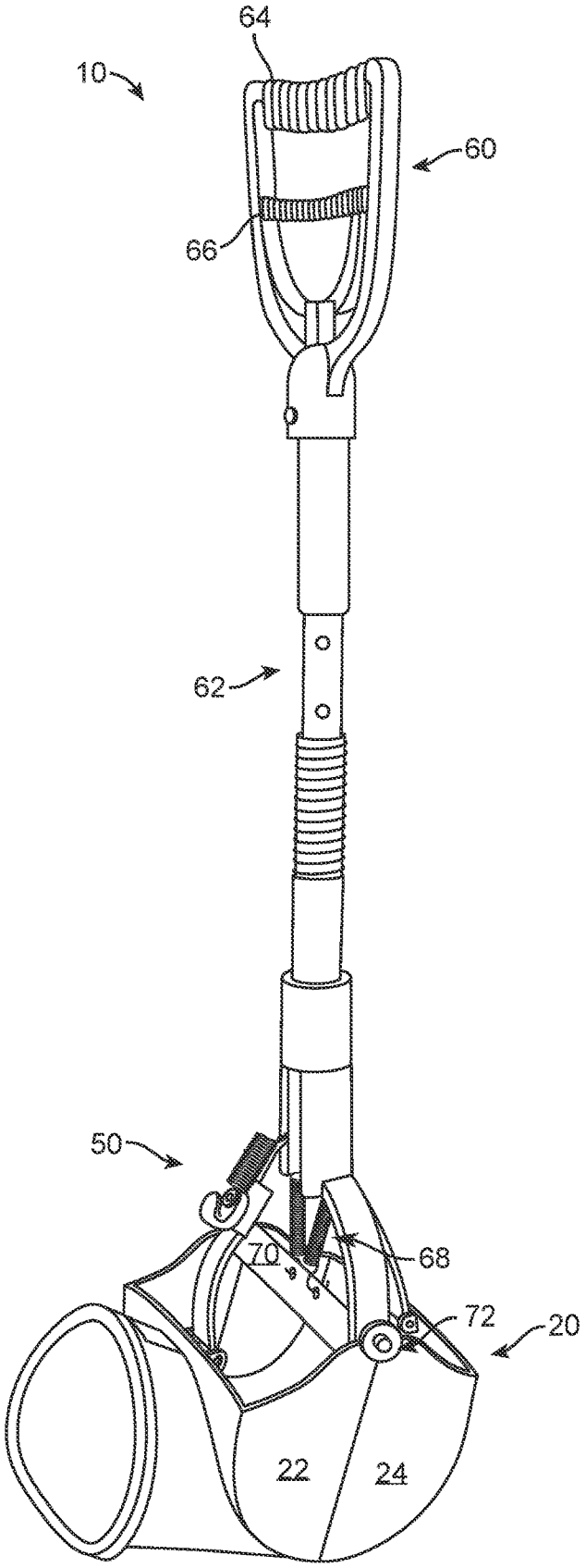
FIG. 1 is illustration of a scooper apparatus according to an embodiment of the present invention.

FIG. 1 is illustration of a scooper apparatus according to an embodiment of the present invention. Referring now to FIG. 1, the scooper apparatus 10 is illustrated. In one embodiment, an article-engaging assembly 20 and a spring-loaded bag-retaining member 50 in the form of a spring-loaded hook are attached to a handle 60 through an interconnecting elongated member 62. The handle is configured to assist the user in picking up an article 11 (best seen in FIG. 12). In one embodiment, the handle comprises an outer handle 64 and inner handle 66, wherein the inner handle 66 facilitates the article-engaging assembly 20 to open and close a pair of opposing article-engaging implements 22, 24 during use. In one embodiment, hinge axel 70 and hinge 72 facilitates the rotation of the pair of opposing article-engaging implements 22,24, wherein a pair of springs 68 control the tension and help to ensure the article-engaging assembly 20 is in a normally closed positioned (as illustrated). It should be understood, that this is only one structured embodiment and operation of opening and closing the article-engaging assembly and other embodiments may be provided. In alternative embodiments, the article-engaging assembly 20 may be in a normally opened position. In some embodiments, the interconnecting elongated member 62 may be adjusted in length, and may fold for easy storage of the apparatus. More details of the present invention will be discussed below.

Figure 2:
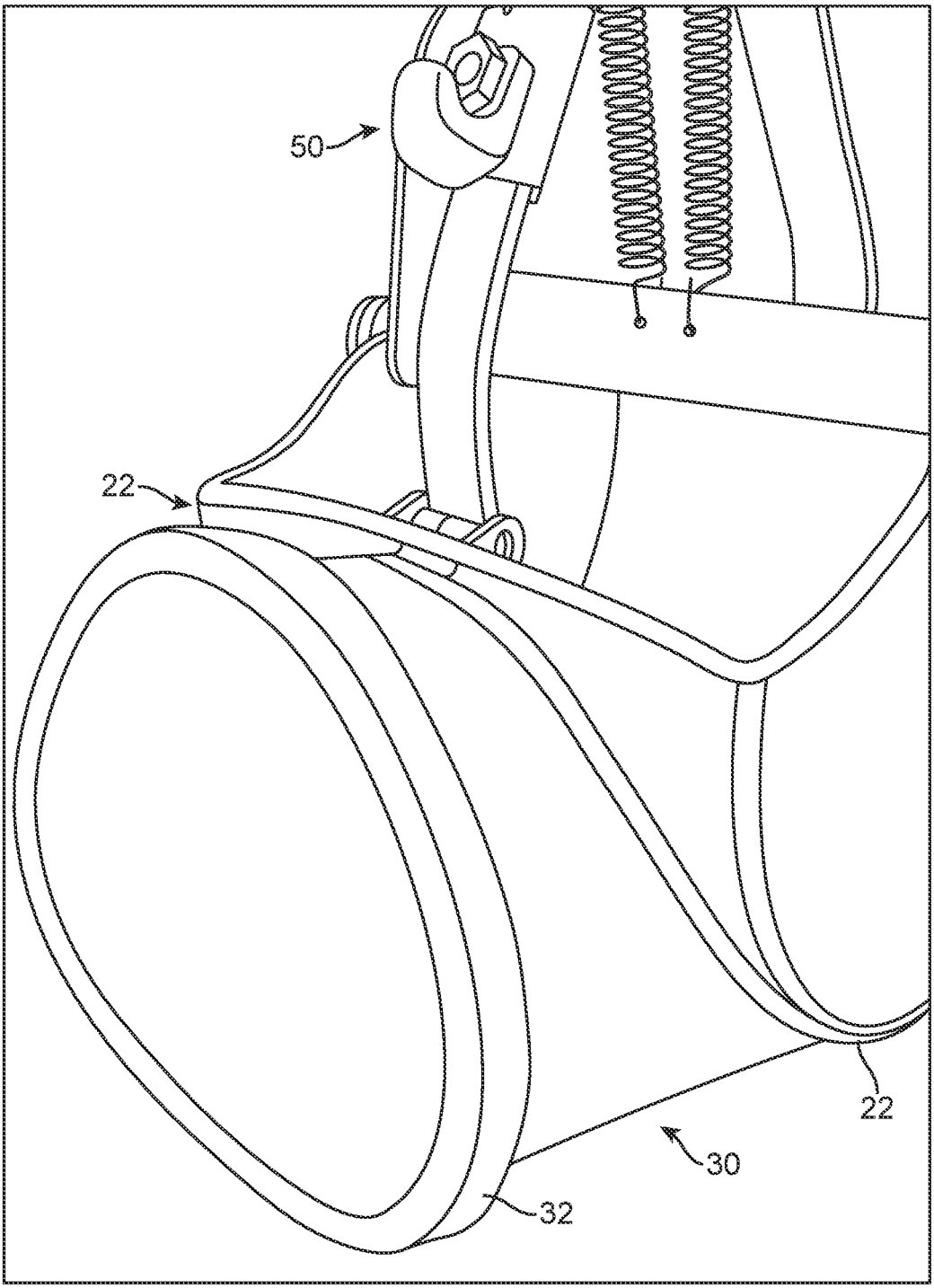
FIG. 2 is a close-up illustration of the lower end of the scooper apparatus of FIG. 1 containing the article-engaging assembly.

FIG. 2 is a close-up illustration of the lower end of the scooper apparatus of FIG. 1 containing the article-engaging assembly 20. Referring now to FIG. 2, in one embodiment, the article-engaging assembly 20 includes an article-engaging implement 22 with a chute 30 extending from the article-engaging implement 22. In one embodiment, one end of the chute 30 terminates at the interior of the article-engaging implement 22. In one embodiment, the opposing end of the chute 30 terminates exteriorly of the article-engaging implement 22 forming a raised lip 32. In one embodiment, the chute is comprised of a tubular member. A close up detail of the hook-shaped bag-retaining member 50 can be seen in this view. In one embodiment, the raised lip 32 is integrated as a single member without the chute. Likewise, the chute 30 may be integrated as a single member with the article-engaging implement 22.

Figure 3:
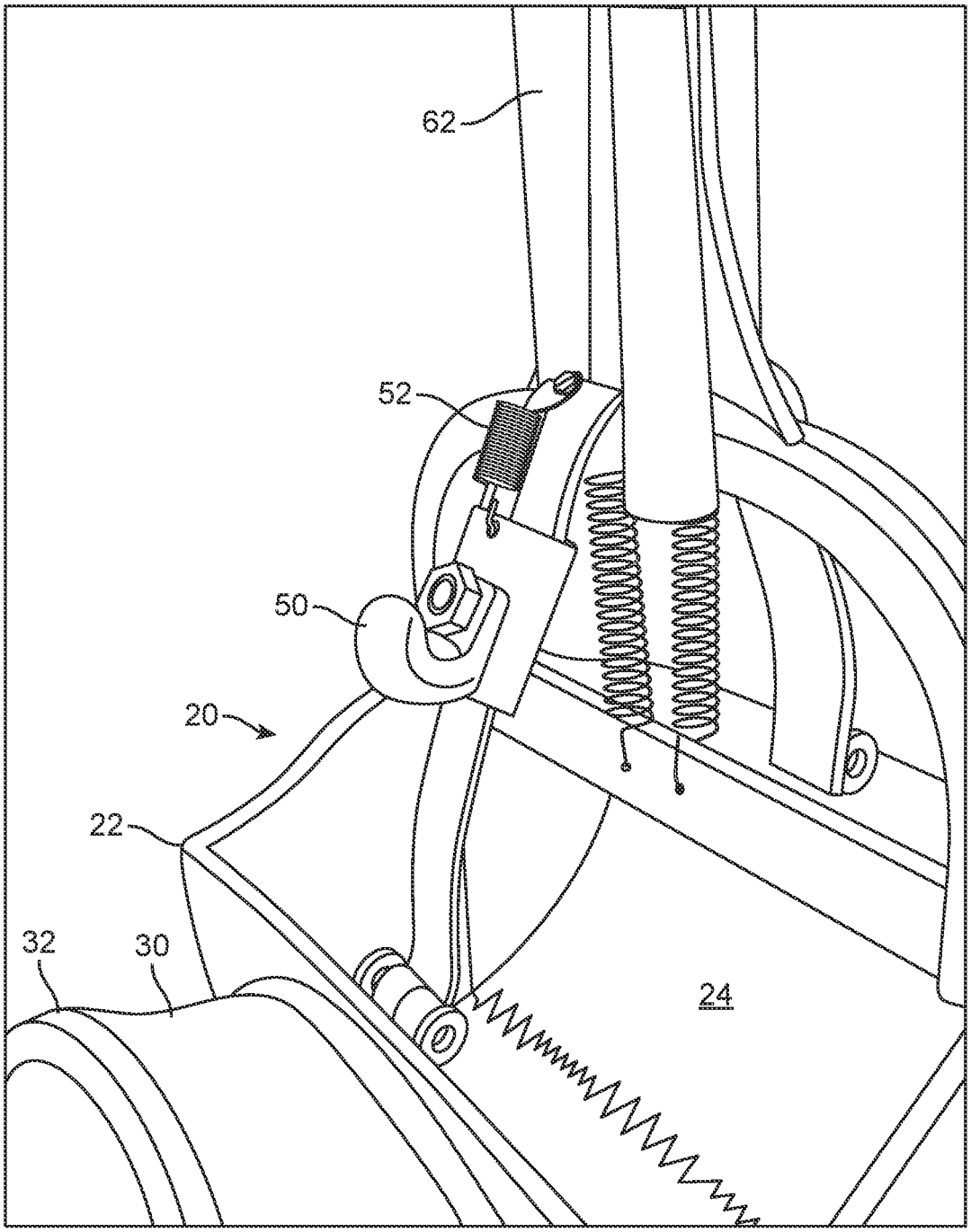
FIG. 3 is another close-up illustration of the scooper apparatus of FIG. 1 containing the article-engaging assembly.

FIG. 3 is another close-up illustration of the scooper apparatus of FIG. 1 containing the article-engaging assembly. Referring now to FIG. 3, interiors of the pair of opposing article-engaging implements 22, 24 can be seen. In one embodiment, the interiors have a generally concave configuration. The tubular-shaped chute 30 can again be seen in this close-up view. The hooked configuration of bag-retaining member 50 is shown, wherein a spring 52 is configured to hold the bag-retaining member 50 in a retracted or biased position where it is positioned farthest from the chute 30. The manner in which both the article-engaging assembly 20 and bag-retaining member 50 depend from the connecting member 62 is also shown in this view and will be discussed in further detail below.

Figure 4:
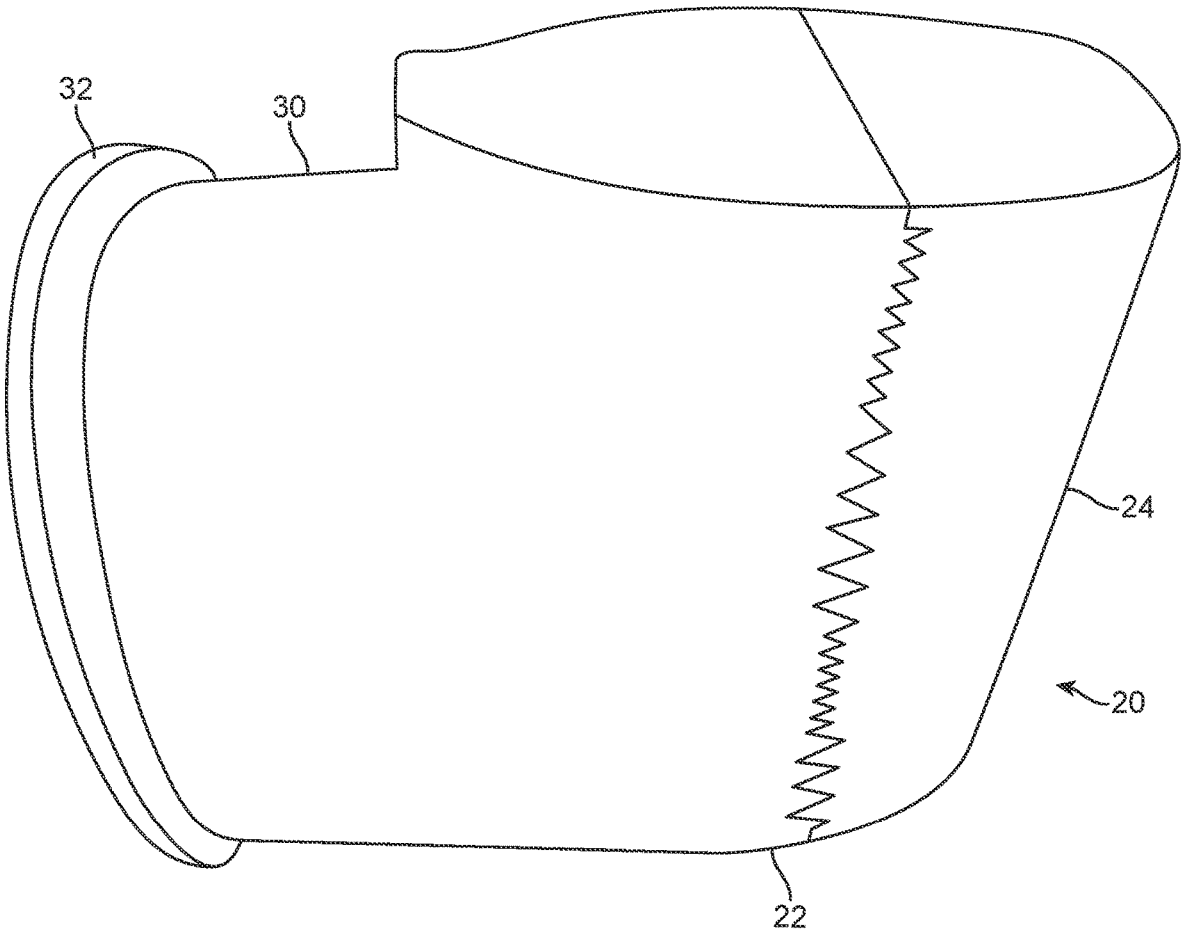
FIG. 4 is a close-up illustration of the scooper apparatus of FIG. 1 viewing the article-engaging assembly from a bottommost vantage point.

FIG. 4 is a close-up illustration of the scooper apparatus of FIG. 1 viewing the article-engaging assembly from a bottommost vantage point. Referring now to FIG. 4, the pair of opposing article-engaging implements 22, 24 are shown in closed condition with respect to one another. The chute 30 is shown extending from one article-engaging implement 22. In one embodiment, the article-engaging implements 22 and the chute is formed as one piece, which may be molded plastic or other known materials. Advantageously, the lip 32 is provided at the termination of the chute 30.

Figure 5:
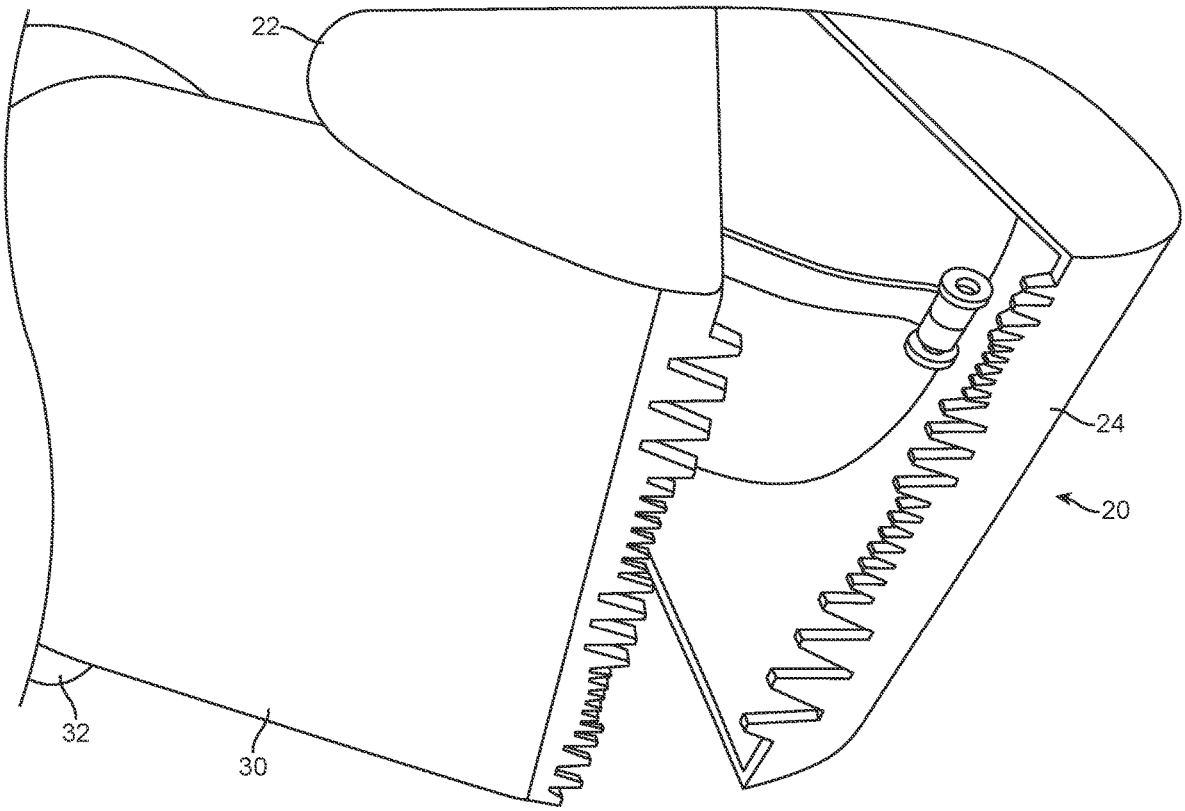
FIG. 5 is another close-up illustration of the scooper apparatus of FIG. 1 viewing the article-engaging assembly from a bottommost vantage point with ends of the opposing article-engaging implements pivoted away from one another.

FIG. 5 is another close-up illustration of the scooper apparatus of FIG. 1 viewing the article-engaging assembly from a bottommost vantage point with ends of the opposing article-engaging implements pivoted away from one another. Referring now to FIG. 5, the underside of the article-engaging assembly 20 is illustrated. In this partial view, the ends of the article-engaging implements 22, 24 are shown slightly pivoted away from one another placing the article-engaging assembly 20 in an open condition. In this open condition, the interior of the other generally concave article-engaging implement 24 is shown. In the embodiment illustrated, the article-engaging implements 22, 24 are bucket-like elements pivotable about a common axis so as to perform in the manner of opening and closing jaws configured to pick of the waste during use.

Figure 6:
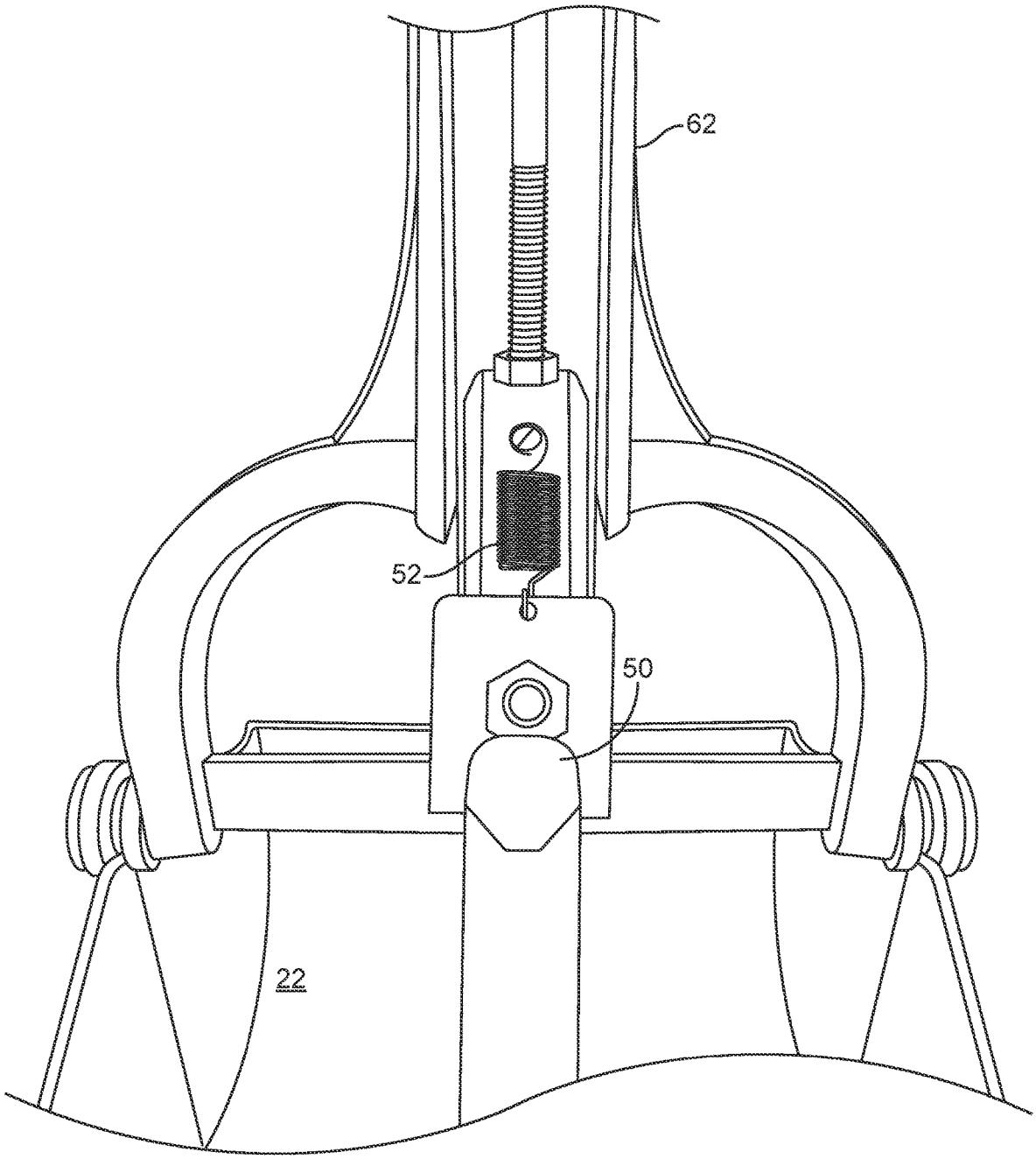
FIG. 6 is a close-up illustration of the scooper apparatus of FIG. 1 focusing upon the bag-engaging member.

FIG. 6 is a close-up illustration of the scooper apparatus of FIG. 1 focusing upon the bag-engaging member. Referring now to FIG. 6, in this full-frontal close-up view, more details of the bag-engaging member 50 and its spring 52 are shown. The spring 52 employed in the exemplary embodiment shown is a tension type of spring in its normally-compressed resting state. In this condition, the bag-engaging member is retracted to a position (distal) the chute (not shown in this view). The article-engaging implement 22 from which the chute extends is shown in this view. In one embodiment, the alignment among the connecting member 62 extending from the handle (not shown in this view), the bag-engaging member 50, and the article-engaging implement 22 is shown.

Figure 7:
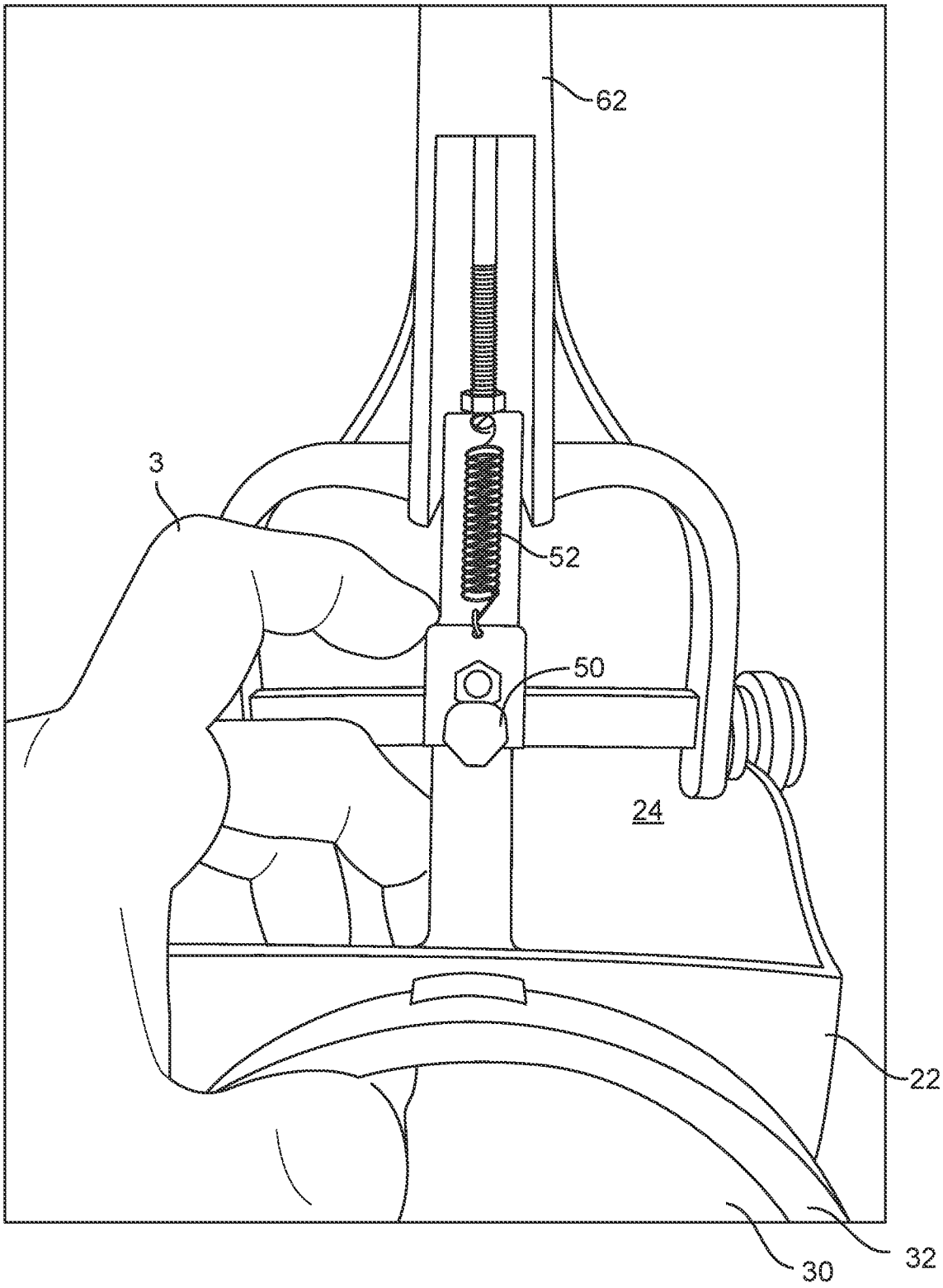
FIG. 7 is a close-up illustration of the article-engaging assembly of the scooper apparatus of FIG. 1 showing the spring-loaded bag-engaging member in an extended condition.

FIG. 7 is a close-up illustration of the article-engaging assembly of the scooper apparatus of FIG. 1 showing the spring-loaded bag-engaging member in an extended condition. Referring now to FIG. 7, alignment of several features of the invention is shown in a partial front view. In one embodiment, the bag-engaging member 50 and article-engaging implements 22, 24 are shown depending from the connecting member 62 that extends from the handle (not shown in this view). A front-on view of the chute 30 is also shown. The manner in which the bag-engaging member 50 is placed in a ready position for receiving a bag (not shown in this view) is shown. More specifically, a hand 3 of an individual is shown grasping the article-engaging implement 22, the chute 22 opening, and the bag-engaging member 50 simultaneously while the forefinger of the individual's hand 3 engages the bag-engaging member 50 and moves the bag-engaging member 50 to an extended position. In the view shown, the spring 52 is extended from its resting, compressed condition to an extended, tension condition where it seeks to return to its compressed condition which allows the bag to be installed on the bag-engaging member 50 and around the chute 30 via the raised lip 32. The details of the installation of the bag will be discussed in further detail below.

Figure 8:
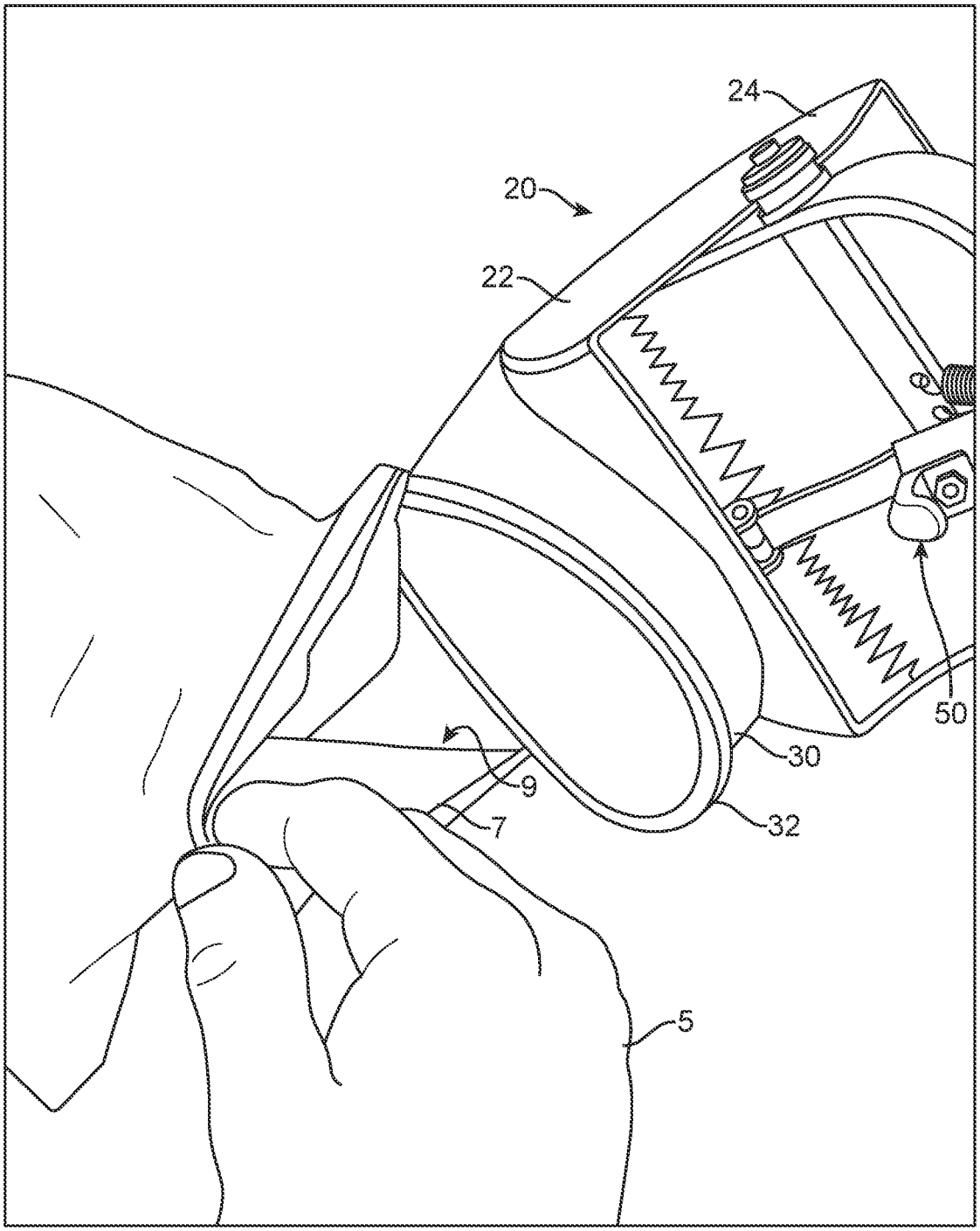
FIG. 8 is a close-up illustration of the article-engaging assembly of the scooper apparatus of FIG. 1 showing a bag being initially fitted over the lip of the tubular member chute extending from the article-engaging implement.

FIG. 8 is a close-up illustration of the article-engaging assembly of the scooper apparatus of FIG. 1 showing a bag being initially fitted over the lip of the tubular member chute extending from the article-engaging implement. Referring now to FIG. 8, therein is shown another hand 5 of an individual in the initial stage of installing a bag 7 into position on the article-engaging assembly 20 of the scooper apparatus. In the installation of the bag 7 of one embodiment, first a portion of the perimeter of the opening 9 of the bag 7 is fitted over a lower portion of the lip 32 of the chute 30. As previously described, the chute 30 extends from an article-engaging implement 22. The opposing article-engaging implement 24 and the bag-retaining member 50 can be seen in this view.

Figure 9:
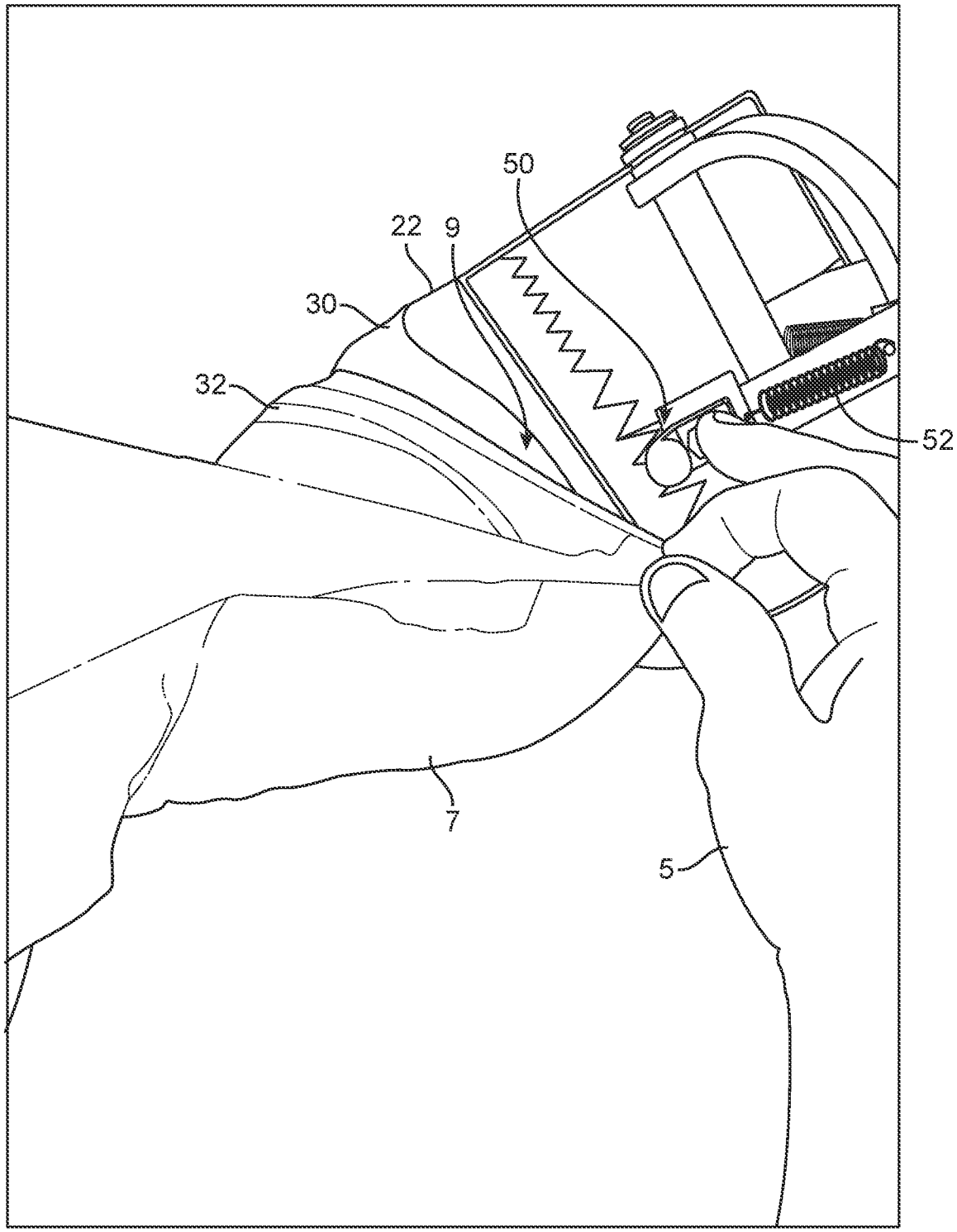
FIG. 9 is a close-up illustration of the article-engaging assembly of the scooper apparatus of FIG. 1 with a bag fitted over the lip of the tubular member chute and the bag-engaging member held in an extended position for receiving the bag.

FIG. 9 is a close-up illustration of the article-engaging assembly of the scooper apparatus of FIG. 1 with a bag fitted over the lip of the tubular member chute and the bag-engaging member held in an extended position for receiving the bag. Referring now to FIG. 9, therein is shown a latter stage in the installation of the bag 7 with respect to the scooper apparatus 10. In this stage of installation of the bag 7, the hand 5 of the individual has fitted most of the perimeter 9 of the bag 7 over the lip 32 of the chute 30. Several fingers of the same hand 5 grasp a free portion of the perimeter 9 of the bag 7 while another finger of the hand 5 engages and pulls the bag-engaging member 50 downwardly to an extended position closer to the chute 30. The manner in which the spring 52 of the bag-engaging member 50 is extended and drawn into tension enables a perimeter edge of the bag to engage the bag-engaging member 50.

Figure 10:
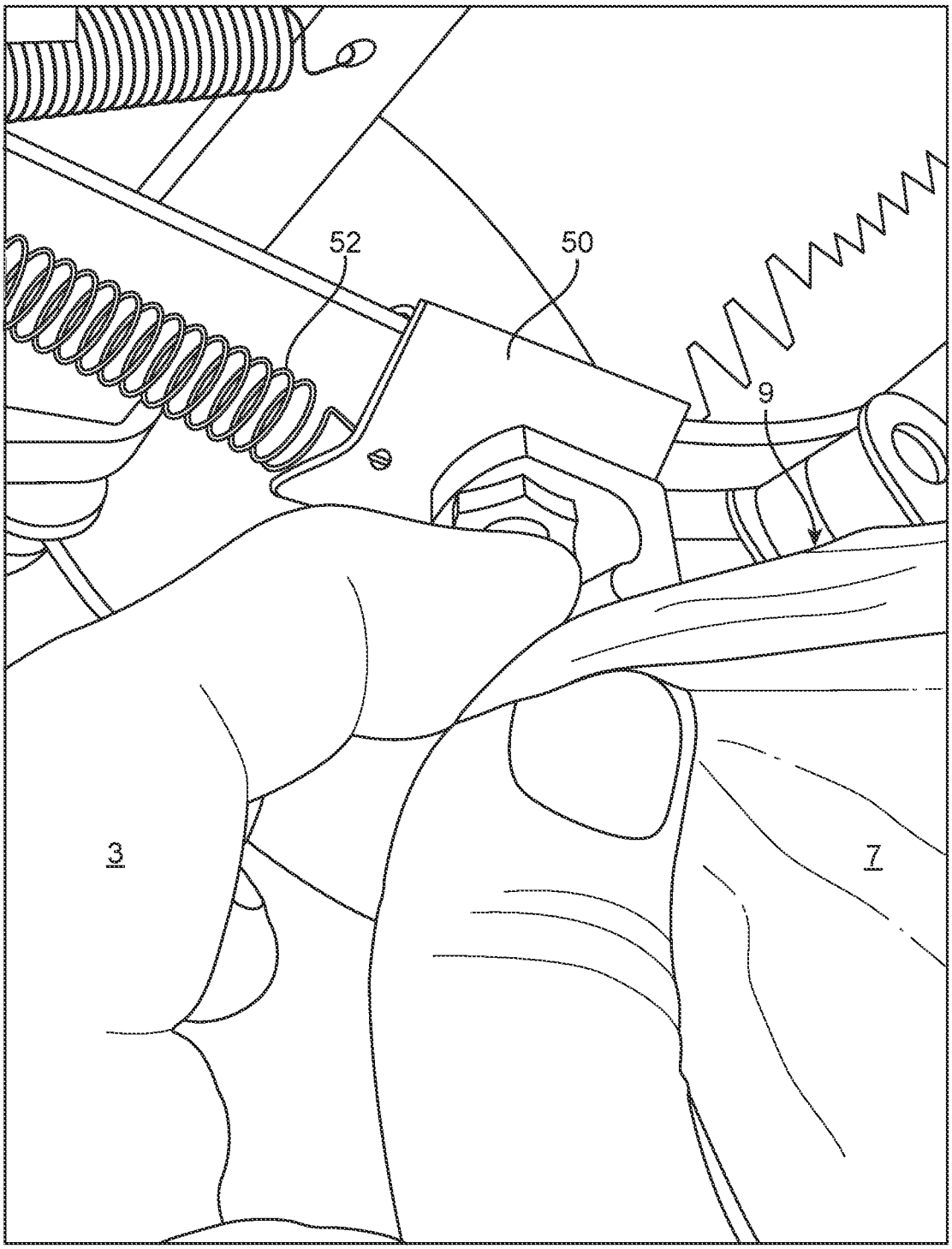
FIG. 10 is a close-up illustration of the article-engaging assembly of the scooper apparatus of FIG. 1 showing the bag being fitted over the hook of the bag-engaging member.

FIG. 10 is a close-up illustration of the article-engaging assembly of the scooper apparatus of FIG. 1 showing the bag being fitted over the hook of the bag-engaging member. Referring now to FIG. 10, the final stage of the placement of the bag 7 onto the scooper apparatus 10 is illustrated. In this extremely close-up view, a free hand 3 of the individual is shown fitting a point on the perimeter 9 of the bag 7 over the hooked end of the bag-engaging member 50. In this view, the tension spring 52 of the bag-engaging member 50 is shown in an extended, tensioned condition.

Figure 11:
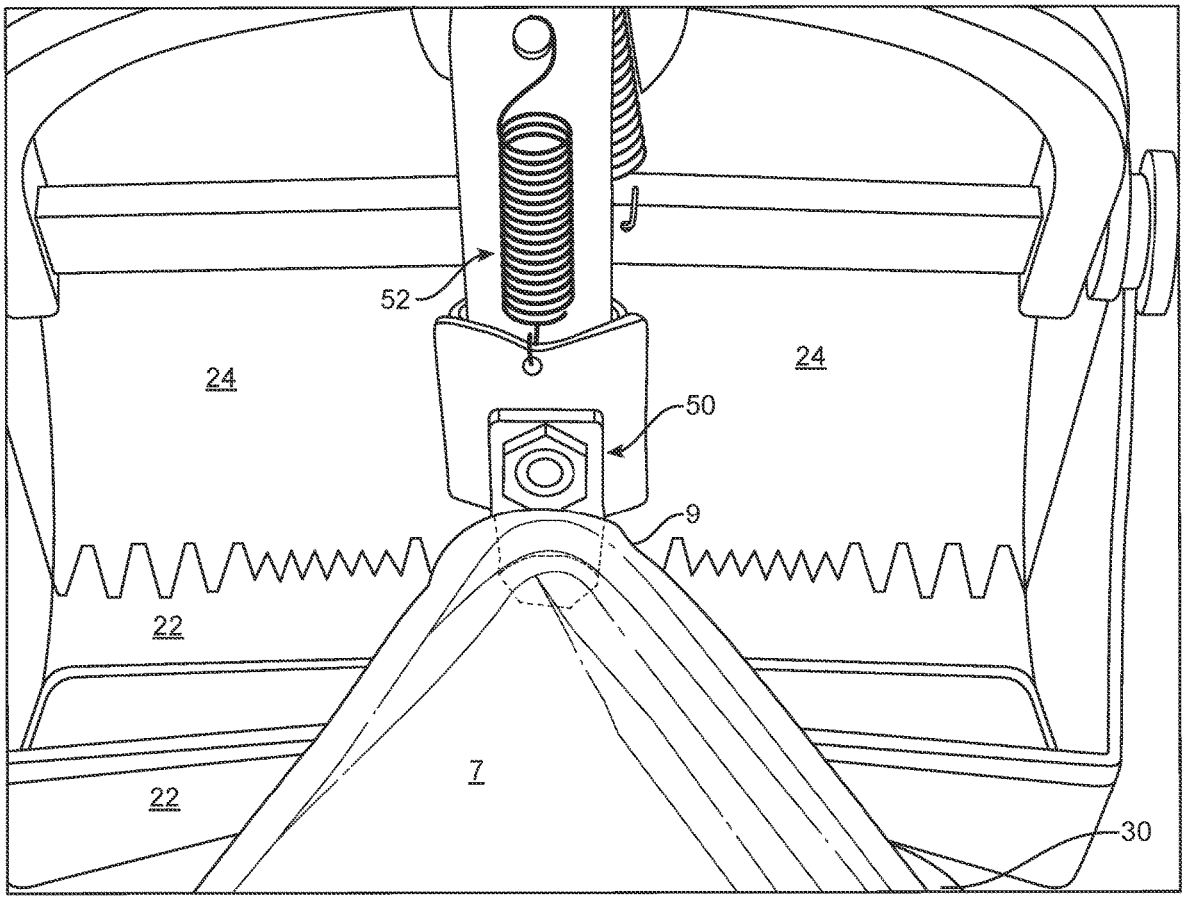
FIG. 11 is a close-up illustration of the article-engaging assembly of the scooper apparatus of FIG. 1 with a perimeter of the bag fully engaged by the hook of the bag-engaging member.

FIG. 11 is a close-up illustration of the article-engaging assembly of the scooper apparatus of FIG. 1 with a perimeter of the bag fully engaged by the hook of the bag-engaging member. Referring now to FIG. 11, the final resting disposition of the portion of the bag 7 engaged by the bag-engaging member 50 is shown. In one embodiment, the perimeter 9 of the bag 7 is shown captured by the hooked end of the bag-engaging member 50 after the spring 52 of the bag-engaging member 50 has retreated to its compressed condition thereby retracting the bag-engaging member 50. The extension of the chute 30 from the article-engaging implement 22 is shown in this view. The interior surfaces of the opposing article-engaging implements 22, 24 are also shown in this view. With the bag 7 fully installed upon the bag-engaging member 50 the scooper apparatus 10 of the invention is ready for use.

Figure 12:
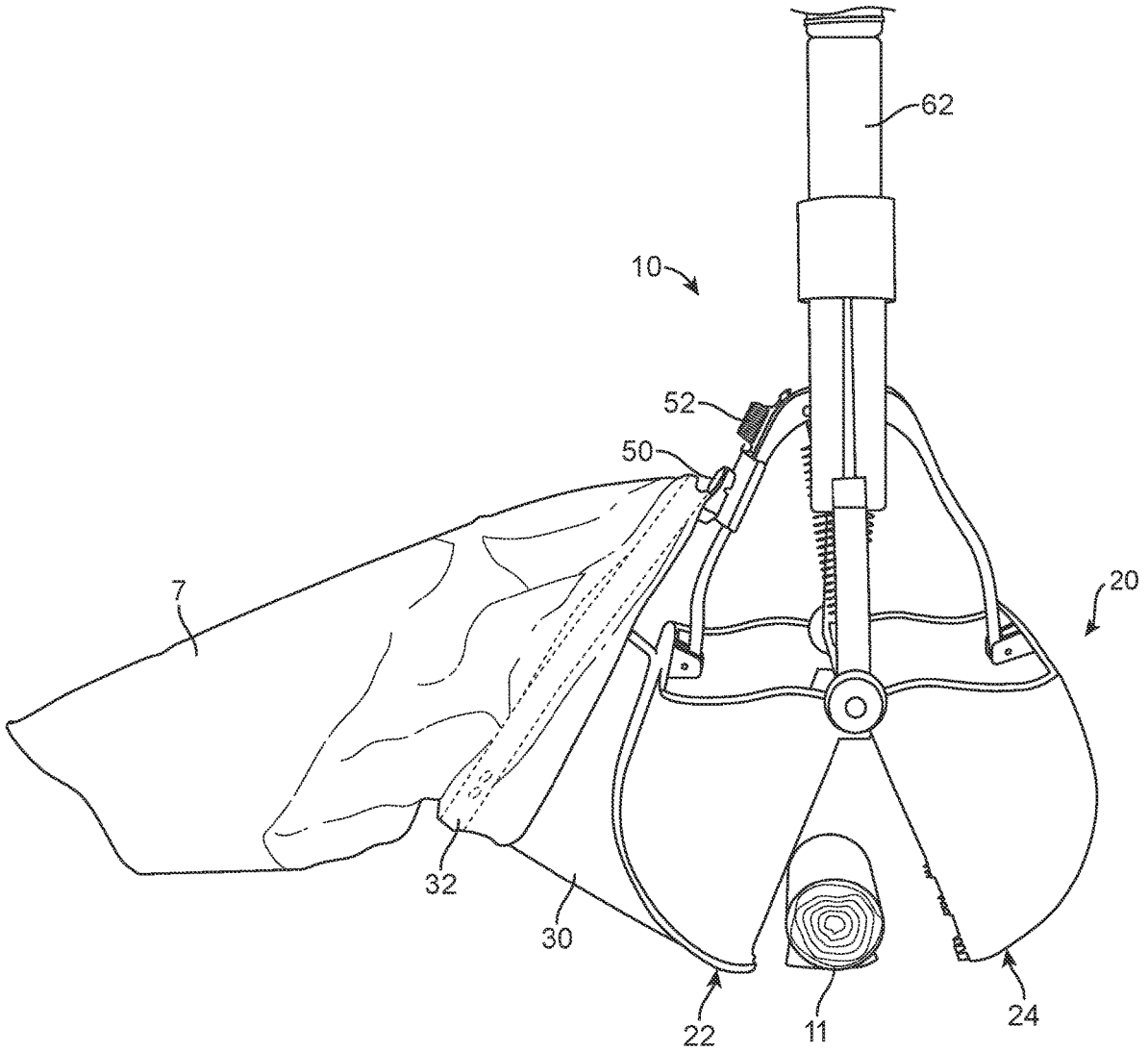
FIG. 12 is a close-up illustration of the scooper apparatus of FIG. 1 with a bag fully attached and the pair of article-engaging implements in an open condition positioned over an article to be picked up.

FIG. 12 is a close-up illustration of the scooper apparatus of FIG. 1 with a bag fully attached and the pair of article-engaging implements in an open condition positioned over an article to be picked up. Referring now to FIG. 12, the scooper apparatus 10 is shown is use with article-engaging implements 22, 24 rotated away from one another in an open-jawed condition over an article 11 in the nature of the article to be gathered. The bag 7 is shown fully installed with its perimeter firmly secured over the lip 32 of the chute 30. In this position, the spring 52 of the bag-engaging member 50 is compressed. The manner in which the article-engaging assembly 20 is positioned for use at the end of the connecting member 62 is shown in this view. Advantageously, the raised lip 32 ensures the bag remains in position during use, and serves a critical function when installing the bag 7 as previously described, as the raised lip provides a flanged edge to prevent the perimeter of the bag from slipping off the end of the chute. It should be noted, the size of the diameter of the raised lip (and chute) and the distance to the bag-engaging member 50, both in an extending and compressed position, may vary based on the size of the bag. However, the sizing is critical such that the bag may be retained during use and installed. The apparatus 10 is intended to be used with a standard size waste bag although may be adjusted to accommodate different size bags.

Figure 13:
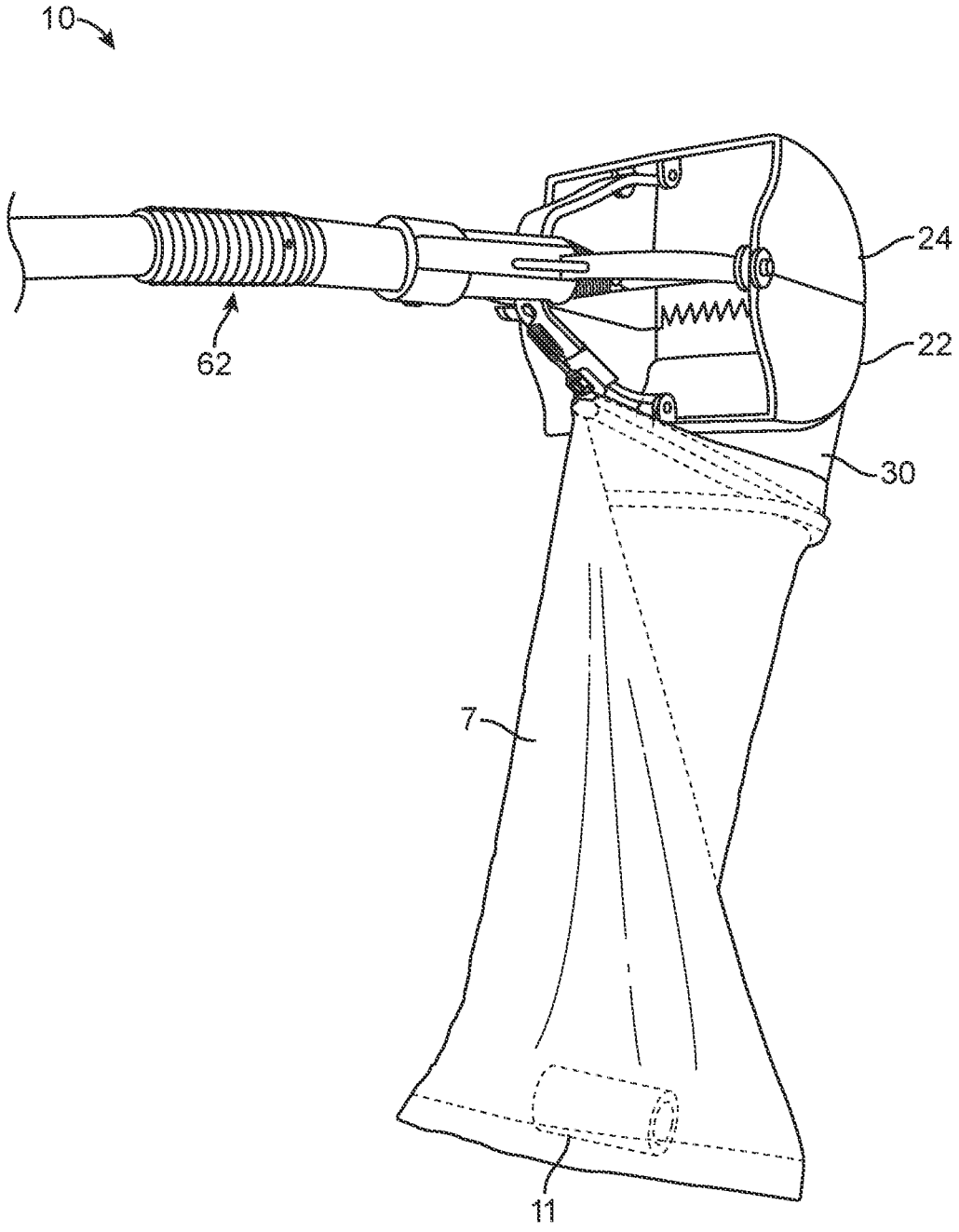
FIG. 13 is a close-up illustration of the scooper apparatus of FIG. 1 with an article picked up and contained in the bottom of the bag ready for removal and disposal.

FIG. 13 is a close-up illustration of the scooper apparatus of FIG. 1 with an article picked up and contained in the bottom of the bag ready for removal and disposal. Referring now to FIG. 13, the article 11 has been captured within the bag 7 and held at a distance through the connecting member 62. The scooper apparatus 10 has been rotated to an orientation whereby the article 11 is disposed within the bottom of the bag 7. After the article 11 has been positioned in the bottom of the bag 7, the bag 7 can be removed from the apparatus 10 by reversing the steps previously described for securement of the bag 7 to the apparatus. As a first step, the bag-engaging member 50 is moved to a position closer to the chute 30 such that the tension placed upon the perimeter of the bag 7 is relaxed sufficiently to permit the bag to be removed from the lip 32 of the chute 30. The bag 7 is then removed and properly disposed of. Once the perimeter 9 of the bag 7 is fully fitted over the lip of the chute 30 and onto the bag-engaging member 50, the spring 52 of the bag-engaging member 50 exerts a compressive force to return the spring 52 to its compressed condition thereby retracting the bag-engaging member and holding the bag 7 in place. The apparatus is then ready for use. The process by which the bag 7 is installed on the apparatus 10 is reversed to remove the bag 7 once it contains an article to be disposed of. The bag 7 is removed and can be disposed of without the individual ever coming into contact with the article. In one embodiment, the article is poop, but it should be understood that other articles may be picked up and disposed of without requiring physical contact with the article. Advantageously, multiple articles may be picked up and deposited into the bag 7 before removable of the bag 7. Due to the raised lip 32 and strength of the bag-engaging member 50 and spring 52, many articles may be deposited into the bag while the bag is retained on the apparatus. This is especially usefully for large cleanup jobs. This and the chute enables a user to pick up multiple articles using a single bag, without having the previous article that was picked up fall out.

As described and illustrated herein, the invention provides an apparatus and methodology for quick, easy and safe retrieval and disposal of articles from a surface. It is designed to be employed with plastic bags that are the standard means of disposing of waste. Articles can be retrieved and disposed of by an individual without the hands of the individual ever coming into contact with the articles. The apparatus can be easily and conveniently rinsed off or otherwise cleaned after use without the hands of an individual ever coming into contact with surfaces that have been engaged by the articles Many variations and modifications may be made to the above-described embodiments without departing from the scope of the claims. All such modifications, combinations, and variations are included herein by the scope of this disclosure and the following claims.

The article-engaging implement can have various configurations that are adapted for securing an article from a surface. The article-engaging implements in the embodiment illustrated and described herein have bucket-like configurations that form concave interior surfaces that are suitable for at least momentarily retaining an article that is picked up. Other configurations including more planar configurations would also be suitable. There can be other means of placing the bag-engaging in a ready position and then into a bag-engaging position other than spring loading, but spring loading is a simple, effective means. The invention contemplates that springs other than the tension type of spring of the embodiment illustrated and discussed can be used to spring-load and bias the bag-engaging member.

The apparatus and methodology taught by the invention can be applied to retrieval and subsequent disposition of solid objects other than animal poop from a surface.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated and can be made without departing from the spirit and scope of the invention.

All references throughout this application, for example, patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

Unless otherwise defined, all technical terms used herein have the same meaning as commonly understood by one of ordinary skill in the art to which this disclosure belongs.

As used herein, the singular forms "a," "an," and "the" include plural references unless the context clearly dictates otherwise. Any reference to "or" herein is intended to encompass "and/or" unless otherwise stated.

As used herein, the term "about" refers to an amount that is near the stated amount by about 0%, 5%, or 10%, including increments therein.

Unless otherwise defined, all technical terms used herein have the same meaning as commonly understood by one of ordinary skill in the art to which this disclosure belongs.

Any element in a claim that does not explicitly state "means for" performing a specified function, or "step for" performing a specified function, is not to be interpreted as a "means" or "step" clause as specified in 35 U.S.C. § 112, ¶ 6. In particular, any use of "step of" in the claims is not intended to invoke the provision of 35 U.S.C. § 112, ¶ 6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A scooper apparatus comprising:

a handle;

an article-engaging assembly having a pair of article-engaging implements depending from the handle defining an interior and an exterior adapted for engaging a waste article from a surface and retaining the waste article within the interior;

a chute extending laterally from a first article-engaging implement of the pair of article-engaging implements, wherein the chute has a first end terminating at an interior of the article-engaging assembly and an opposing second end distal of the first end, wherein the second end is adapted for receiving an open end of a bag;

a raised lip positioned on an entire perimeter edge of the second end of the chute; and, a bag-retaining member configured to engage a perimeter of an open end of the bag, wherein the bag-retaining member comprises a hook and is spring loaded via a tension spring.

2. The scooper apparatus of claim 1, wherein the bag-retaining member is configured to move from a retracted position to an extended position via the tension spring, wherein the retracted position is distal of the poop chute and the extended position is proximate of the chute.

3. The scooper apparatus of claim 1, wherein the chute, the raised lip, and the first article-engaging implement is constructed as a single member.

4. A scooper apparatus comprising:

a handle;

at least one article-engaging implement depending from the handle defining an interior and an exterior adapted for engaging an article from a surface and retaining within the interior;

a tubular member extending laterally from the at least one article-engaging implement having a first end terminating at an interior of the article-engaging implement and an opposing second end distal the first end adapted for receiving an open end of a bag; and a bag-retaining member disposed proximate the second end of the tubular member adapted for engaging a perimeter of the open end of the bag, wherein the bag-retaining member is a hook.

5. The scooper apparatus of claim 4, where the article-engaging implement defines a concave interior surface.

6. The scooper apparatus of claim 4, wherein the second end of the tubular member has a raised-lip perimeter.

7. The scooper apparatus of claim 4, wherein the bag-retaining member is spring-loaded.

8. The scooper apparatus of claim 7, wherein the bag-retaining member is spring-loaded between a retracted position distal the tubular member and an extended position proximate the tubular member.

9. The scooper apparatus of claim 4, further comprising an elongated connecting member having the at least one article-engaging implement disposed at one end and the handle disposed at an opposing end.

10. The scooper apparatus of claim 9, further comprising a mechanism for selectively moving the pair of opposing article-engaging implements between a closed condition and an open condition.

11. The scooper apparatus of claim 4, the at least one article-engaging implement comprising a pair of opposing article-engaging implements adapted for engaging an article therebetween.

12. A method of retaining a flexible bag on a scooper apparatus, the method comprising steps:

(a) providing the scooper apparatus having a handle; an article-engaging assembly having a pair of article-engaging implements depending from the handle defining an interior and an exterior adapted for engaging a waste article from a surface and retaining within the interior; a chute extending laterally from a first article-engaging implement of the pair of article-engaging implements, wherein the chute has a first end terminating at an interior of the article-engaging assembly and an opposing second end distal of the first end; a raised lip positioned on an entire perimeter edge of the second end of the chute; and, a bag-retaining member configured to engage a perimeter of an open end of the bag, wherein the bag-retaining member is spring loaded via a tension spring;

(b) placing an open end of the flexible bag over the second end of the poop chute and the raised lip;

(c) positioning the bag-retaining member in an extended position by applying a force on the bag-retaining member and extending the tension spring;

(d) engaging a portion of the flexible bag on the bag-retaining member; and, (e) positioning the bag-retaining member in a retracted positioned, by releasing the force, such that the portion of the flexible bag is secured on the bag-retaining member.

* * * * *